United States Patent [19]

Morikawa et al.

[11] 4,138,978

[45] Feb. 13, 1979

[54] TWO-OPEN-POSITION CHOKE VALVE CONTROL SYSTEM

[75] Inventors: Toshio Morikawa, Toyota; Keiichi Okabayashi, Aichi, both of Japan

[73] Assignee: Toyota Jidosha Kogyo Kabushiki Kaisha, Toyota, Japan

[21] Appl. No.: 734,868

[22] Filed: Oct. 22, 1976

[30] Foreign Application Priority Data

Jul. 20, 1976 [JP] Japan ..... 51-85562

[51] Int. Cl.[2] ..... F02M 1/10

[52] U.S. Cl. ..... 123/119 F; 261/39 B

[58] Field of Search ..... 123/119 F; 261/39 A, 261/39 B, 64 C

[56] References Cited

U.S. PATENT DOCUMENTS

| | | | |
|---|---|---|---|
| 2,609,806 | 9/1952 | Winkler | 261/39 B |
| 3,523,680 | 8/1970 | Bartholomew | 261/39 B |
| 3,606,983 | 9/1971 | Mitchell | 261/39 B |
| 4,027,634 | 6/1977 | Benjamin | 261/39 B |

FOREIGN PATENT DOCUMENTS

| | | | |
|---|---|---|---|
| 2417449 | 10/1975 | Fed. Rep. of Germany | 261/39 B |
| 2439441 | 2/1976 | Fed. Rep. of Germany | 261/39 B |
| 51-7774 | 3/1976 | Japan. | |

*Primary Examiner*—Ronald H. Lazarus
*Assistant Examiner*—David D. Reynolds
*Attorney, Agent, or Firm*—Stevens, Davis, Miller & Mosher

[57] ABSTRACT

This application discloses a two-open-position choke valve control system comprising:

a housing;

a first diaphragm which is linked with a choke valve shaft;

a second diaphragm;

a prop rod arranged between said first and second diaphragms, the length of the rod being shorter than the distance between said first and second diaphragms during their release conditions;

a stopper means which prevents said second diaphragm from moving toward said first diaphragm;

a first chamber formed between said first and second diaphragms and communicating with an intake pipe at the downstream of a carburetor throttle valve, and;

a second chamber formed outside of said second diaphragm and communicating with said intake pipe through a device for detecting the driving conditions of a vehicle.

3 Claims, 2 Drawing Figures

TWO-OPEN-POSITION CHOKE VALVE CONTROL SYSTEM

BACKGROUND OF THE INVENTION

The present invention relates to a choke valve control system which properly adjusts the opening of a carburetor choke valve of an internal combustion engine in response to the driving conditions of a vehicle.

Generally, a carburetor choke valve opening is controlled by a bimetallic spring which forces the valve to close during low temperatures and by an intake vacuum which acts upon the valve to open due to an eccentric shaft of the valve. Additionally, a diaphragm device is often used to reliably open the valve. The diaphragm device is linked with the choke valve shaft and actuated by the intake vacuum. However, in such a known choke valve control system, at a low temperature or at a low speed condition of the vehicle for example, the valve is sometimes excessively opened by the actuating force of the intake vacuum. Accordingly, in said known system, the choke valve opening is not always properly controlled in response to the driving conditions of the vehicle.

SUMMARY OF THE INVENTION

An object of the present invention is to provide a choke valve control system in which the above-mentioned drawbacks are obviated. Provided by the invention is a two-open-position choke valve control system comprising a dual diaphragm device which cooperates with a device for detecting the driving conditions of the vehicle. Said detecting device comprises a detector of the cooling water temperature and/or a speed detector, etc. Thereby, the choke valve opening is appropriately controlled in response to the driving conditions of the vehicle.

Said two-open-position choke valve control system comprises:

a housing;

a first diaphragm which is linked with a choke valve shaft;

a second diaphragm;

a prop rod arranged between said first and second diaphragms, the length of said rod being shorter than the distance between said first and second diaphragms during their release conditions, i.e., at their original positions;

a stopper means which prevents said second diaphragm from moving toward said first diaphragm;

a first chamber formed between said first and second diaphragms and communicating with an intake pipe at the downstream of a carburetor throttle valve, and;

a second chamber formed outside of said second diaphragm and communicating with said intake pipe through a device for detecting the driving conditions of the vehicle.

BRIEF DESCRIPTION OF THE DRAWINGS

The present invention will now be further described with reference to the accompanying drawings, in which.

DETAILED DESCRIPTION OF THE EMBODIMENTS OF THE INVENTION

Figure 1:
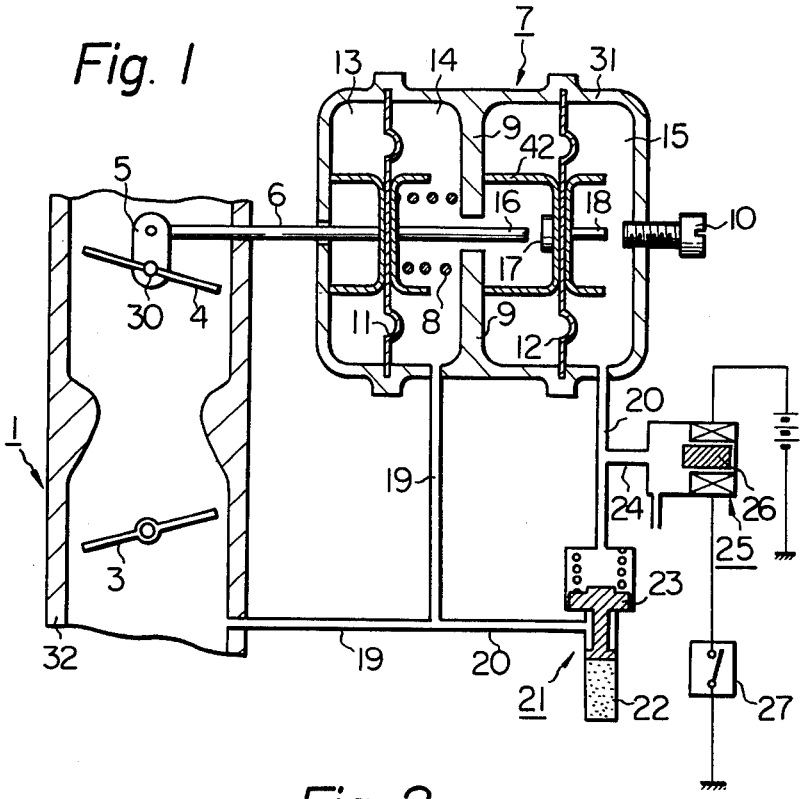
FIG. 1 is a diagrammatic view of an embodiment of the choke valve control system according to the invention.

Referring to FIG. 1, a dual diaphragm device 7 comprises a housing 31 and a first and a second diaphragms 11, 12, respectively, which are arranged in said housing 31. The first diaphragm 11 is linked with a choke valve shaft 30 by a rod 6 and a lever 5 fixed to said shaft 30. Said rod 6 and said lever 5 are pivotally connected. A prop rod 16 extends from said first diaphragm 11 toward said second diaphragm 12. The prop rod 16 does not normally (during the release conditions of the diaphragms) reach to the second diaphragm 12, as shown in the drawing. An internal space 13 of the housing 31 formed outside of the first diaphragm 11 communicates with the atmosphere. A first chamber 14 formed between said first and second diaphragms 11, 12, respectively, communicates with an intake pipe 32 at the downstream of a throttle valve 3 of a carburetor 1 through a communicating pipe 19. A second chamber 15 formed outside of the second diaphragm 12 communicates with said intake pipe 32 through the communicating pipe 19 and through another communicating pipe 20 diverging from said pipe 19. A thermostatic valve 21 which detects the cooling water temperature is arranged on said communicating pipe 20. A relief pipe 24 which opens to the atmosphere diverges from said communicating pipe 20. A solenoid valve 25 which cooperates with a speed detector 27 is arranged on said relief pipe 24. Said thermostatic valve 21 and said speed detector 27 constitute a device for detecting the driving conditions of the vehicle. In the first chamber 14, an annular wall 9 protrudes from the inner circumference of the housing 31. A support member 42 which abuts against said annular wall 9 fixed to the second diaphragm 12. Said annular wall 9 and said support member 42 constitute a stopper means which prevents the second diaphragm 12 from moving toward the first diaphragm 11. A stroke adjuster screw 10 is mounted on the housing 31 in a direction facing the second diaphragm 12. Numeral 8 is a spring, 17 is an abutment member for the prop rod 16, and 18 is a projection member which abuts against the stroke adjuster screw 10.

The operation of the above two-open-position choke valve control system will now be described.

When the coolant is at a low temperature and the vehicle is in an idling condition or in a low speed condition, the thermostatic valve 21 is closed and the speed detector 27 is in an OFF condition. Thereby, the solenoid valve 25 is opened with the result being that the communicating pipe 20 communicates with the atmosphere. Accordingly, the atmospheric pressure acts upon the second chamber 15. Simultaneously, the intake vacuum acts upon the first chamber 14 through the communicating pipe 19. Therefore, the first and second diaphragms 11, 12, respectively, are forced to approach each other. The second diaphragm 12, however, cannot move to the left because the support member 42 abuts against the annular wall 9. Accordingly, the first diaphragm 11 moves to the right. This movement is stopped when the prop rod 16 abuts against the abutment member 17. As the first diaphragm 11 moves to the right, the rod 6 fixed to the first diaphragm 11 also moves to the right with the result being that the choke valve shaft 30 is rotated clockwise by the lever 5. Accordingly, the choke valve 4 opens to the predetermined opening angle defined by the length of the prop rod 16.

After the engine is warmed up and the coolant temperature exceeds a predetermined value (for example, 10° C), a wax 22 in the thermostatic valve 21 expands and forces up a valve 23. Thereby, the thermostatic valve 21 is opened. Under this condition, when the speed detector detects a vehicle speed above the predetermined value (13 km/h, for example), the solenoid valve 25 is energized and a valve 26 moves to the left with the result being that the solenoid valve 25 is closed. Accordingly, the vacuum pressure acts upon the second chamber 15 through the communicating pipes 19, 20. Thereby, the second diaphragm 12 moves to the right, and simultaneously, the first diaphragm 11 also moves to the right. Accordingly, the choke valve shaft 30 which is linked to the first diaphragm 11 by the lever 5, and the rod 6 is rotated clockwise. Thereby, the choke valve opening increases to a second predetermined opening angle. The rotation of the shaft 30 is stopped when the projection member 18 abuts against the stroke adjuster screw 10. Said second predetermined opening angle is adjustable because of the screw 10.

As described above, in the two-open-position choke valve control system according to the invention, in a predetermined driving condition of the vehicle, for example, when the coolant is at a low temperature and/or the vehicle is at a low speed, the choke valve opens to the first predetermined opening angle; and in another condition of the vehicle, for example, when the coolant is warmed up and/or the vehicle is at a normal speed, the choke valve further opens to the second opening angle. Thereby, the choke valve opening can be properly controlled in response to the driving conditions of the vehicle. Such proper control of the choke valve opening makes it possible to avoid the lowering of the output force of the engine when the coolant is at a low temperature and to reduce the toxic emissions such as HC and CO in the exhaust gas because the appropriate air/fuel ratio is attained by said proper control of the choke valve opening.

Figure 2:
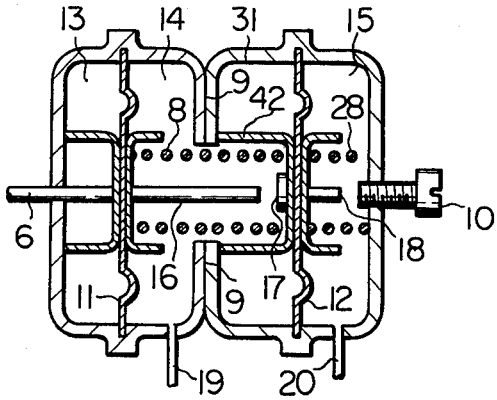
FIG. 2 is a diagrammatic partial view of another embodiment of the invention.

In FIG. 2, another embodiment of the dual diaphragm device according to the invention is illustrated. In this case, a spring 8 is directly arranged between the first and the second diaphragms 11, 12, respectively, in order to repel the two diaphragms from each other. Further, another spring 28 is arranged in the second chamber 15. The operating pressure of the diaphragms is changeable by changing the arrangement of the springs. In the second embodiment shown in FIG. 2, the first diaphragm 11 moves more smoothly than in the first embodiment, especially in the movement from the first open-position to the second open-position.

What is claimed is:

1. A two-open-position choke valve control system comprising:

a first diaphragm linked with a choke valve shaft;

a second diaphragm;

a housing in which said first and second diaphragms are arranged;

a prop rod arranged between said first and second diaphragms, the length of said rod being shorter than the distance between said first and second diaphragms during their release conditions;

a stopper means for preventing said second diaphragm from moving toward said first diaphragm;

a first chamber formed between said first and second diaphragms and communicating with an intake pipe downstream of a carburetor throttle valve; and, a second chamber formed outside of said second diaphragm and communicating with said intake pipe through a device for detecting the driving conditions of a vehicle, said device comprising:

a thermostatic valve mounted on a communicating pipe connecting said second chamber with said intake pipe for detecting the temperature of engine coolant and opening said communicating pipe when said coolant temperature is above a predetermined value, and a solenoid valve mounted on a relief pipe connected to said communicating pipe and coupled to a vehicle speed detector for blocking said communicating pipe from communicating with the atmosphere when the vehicle speed is above a predetermined value.

2. A two-open-position choke valve control system according to claim 1, wherein said stopper means comprises:

an annular wall which protrudes from the inner circumference of said housing in said first chamber, and;

a support member which is fixed to said second diaphragm and abuts against said annular wall.

3. A two-open-position choke valve control system according to claim 1, wherein a stroke adjuster screw is mounted on said housing facing said second diaphragm in order to adjust the stroke of said second diaphragm toward the opposite direction from said first diaphragm.

* * * * *